United States Patent [19]

May, deceased et al.

[11] 3,996,087

[45] Dec. 7, 1976

[54] HONEYCOMB MATERIALS

[75] Inventors: George May, deceased, late of Chawston, England; by Gloria Elizabeth May, executrix; by Heather Miranda Adlam, executrix, both of London, England; Desmond Deverell White, Rhyl, England

[73] Assignee: Dufaylite Developments Limited, Great Britain

[22] Filed: Mar. 4, 1975

[21] Appl. No.: 555,321

[52] U.S. Cl. ..... 156/197; 93/1 H

[51] Int. Cl.[2] ..... B31D 3/02

[58] Field of Search ..... 156/197, 183; 93/1 H

[56] References Cited

UNITED STATES PATENTS

| | | | |
|---|---|---|---|
| 2,704,587 | 3/1955 | Pajak | 93/1 H UX |
| 3,016,315 | 1/1962 | Robinson | 156/197 X |
| 3,909,224 | 9/1975 | Spencer | 156/197 X |

FOREIGN PATENTS OR APPLICATIONS

| | | | |
|---|---|---|---|
| 266,933 | 5/1964 | United Kingdom | 156/197 |

*Primary Examiner*—David A. Simmons
*Attorney, Agent, or Firm*—William Anthony Drucker

[57] ABSTRACT

Unexpanded structural honeycomb material formed of permanently creasable material is extended in its expansion direction and compressed perpendicular to the expansion direction, e.g. between pressure rollers, so that the cells adopt a configuration in which they have dimensions in the expansion direction which are large compared with their dimensions in the direction of compression and the creasable material is creased. On subsequently being allowed to expand, the material adopts a self-sustaining open cellular configuration.

7 Claims, 2 Drawing Figures

HONEYCOMB MATERIALS

Figure 1:
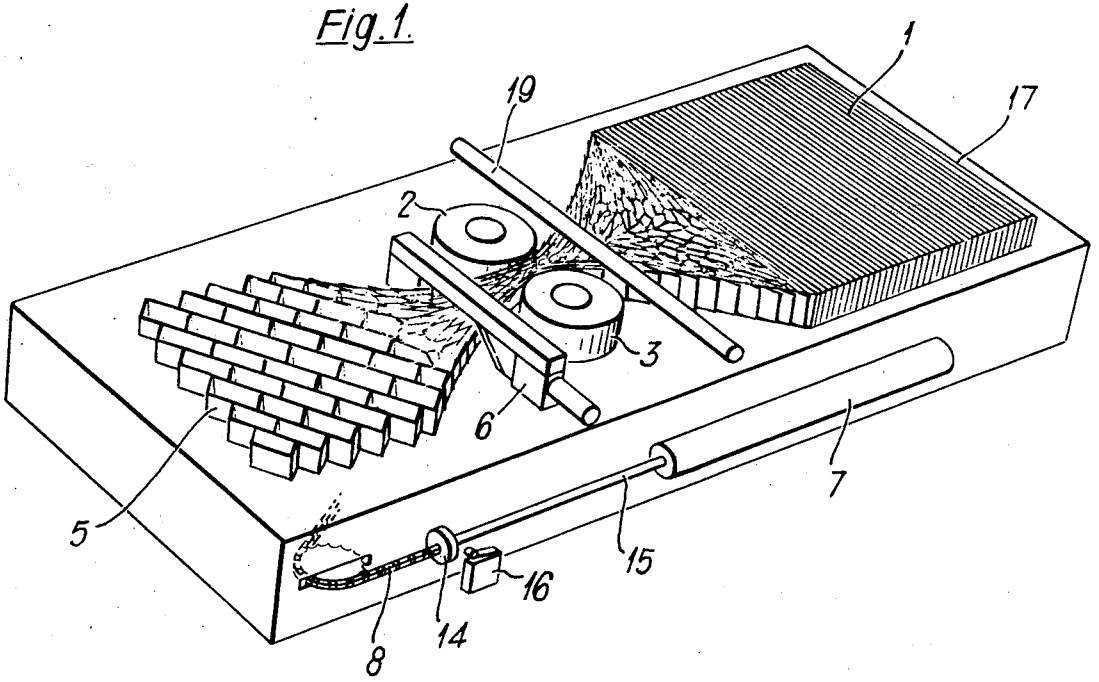

The present invention relates to structural honeycomb materials and their treatment.

The fundamentals of structural honeycomb materials are described in our British patent specification No. 591,772. Various methods have been proposed for the production of such materials and they have in common the formation of an expandable structure consisting of strips of sheet material adhesively secured together in face to face relationship by patches of adhesive spaced apart in the length direction of the strips and so positioned that the bands on one side of any individual strip are staggered with reference to the bands on the other side thereof. This expandable material is normally produced by slicing a block of adhesively secured sheets as described in British patent specification No. 591,772 to yield expandable slices of the desired thickness. Other methods have been proposed which involve producing the material directly in the required thickness without a slicing operation. The direct methods of production have the advantage that they yield the expandable material in a continuous form. Methods involving the slicing of a block have the merit of simplicity and versatility and if the material is required in a continuous form it may be produced by adhering the slices together.

The manner in which the structural honeycomb material is produced in the expandable state is of no consequence as far as the present invention is concerned.

The original use of structural honeycomb materials was as a core material for double skin structures. It is now, however, being used on an increasing scale for packaging purposes as, expanded, its cells provide convenient compartments for the product. It has been used successfully for the packaging of such diverse products as chocolates, products in glass bottles and fruit, especially apples. The high compressive strength of the expanded material in the direction of the major axes of the cells provides the package with valuable load-bearing properties which protect the product from damage.

For reasons of economy in transport, it is almost always necessary to transport the honeycomb material in the unexpanded state and to expand it to the open cellular state immediately prior to filling it with a product to be packaged or even during said filling or, in structural applications, immediately prior to its incorporation in a double skin structure. For maximum convenience it is desirable that the honeycomb material should be brought into a stably expanded state. Various methods for converting the material to the stably expanded state are known. They involve such treatment as resinating, heating or assembly of the material in retaining jigs. They are considered to be uneconomic in the packaging art, especially when applied on a small scale. They are also considered to be uneconomic in structural applications carried out on a small scale or requiring honeycomb material in a wide range of sizes.

For the great majority of purposes, the structural honeycomb material employed is formed from paper, cardboard or similarly permanently creasable material because of its cheapness. By a permanently creasable material is meant a material which forms a permanent crease when sharply folded and which subsequently in the relaxed state tends to fold at the position of the crease as though it has a memory of the configuration in which it was placed at the time of the sharp folding.

Metallic foil is not a permanently creasable material in this sense because it adopts a permanent set when sharply folded, i.e. its relaxed state is the sharply folded state.

In accordance with the present invention there is provided a method of treating an unexpanded structural honeycomb material formed of paper, cardboard or similarly permanently creasable material to convert it to a self-sustaining open cellular state which comprises extending the material in its expansion direction whilst compressing it perpendicular to the expansion direction and to the major axes of the cells so that the cells adopt a configuration in which they have dimensions in the expansion direction which is large compared with their dimensions in the direction of compression and the permanently creasable material is creased, relaxing the compression and allowing the material to contract in the expansion direction to an open cellular state.

Normally, a honeycomb material formed of paper or cardboard contracts almost to its original unexpanded state when the force applied in its expansion direction for expanding it is released. With the product treated by the present method the folding tendency attributable to the creasing limits the amount of contraction and in the result a stably expanded material, in the sense that it is self-sustaining in an open cellular state, is obtained. In this self-sustaining state the cells are widely opened. Even though they may not be geometrically regular, identical in their configuration or expanded to or near the size required in the final package, they are widely open enabling most kinds of products to be inserted with ease. In most cases, e.g. with apples, oranges or bottles, the product holds the honeycomb material to a suitable configuration when inserted and, in the packaging field, the main utility of the present invention is in connection with such cases. Caution should be adopted when applying the invention to the packaging of fundamentally delicate products, for example, filled chocolates.

In a convenient form of the method the extension of the material and its compression may be accomplished by passing the material between a pair of pressure rollers suitably spaced apart (and if desired adjustable in their spacing). One or both of the rollers may be driven in order to exert a pull on the material for extending it, or the rollers may be idler rollers through which the material is pulled. In a very simple form of the method the material is pulled manually as required through a pair of idler rollers. When it is appreciated that the axial length of the rollers need not be greater than the thickness of the material to be treated and in most cases the honeycomb material can be passed through a nip of less than 1 inch it will be understood that the apparatus for carrying out the method can be very simple indeed.

The method may be applied to the treatment of simple slices of honeycomb having a small number of constituent strips, e.g. from 6 to 10 strips expandable to provide a small number of cells, for example to accommodate a layer of apples in a carton, or it may be applied equally well to continuous honeycomb material whether produced directly or by adhering together slices as indicated above.

When a continuous material is treated in accordance with the invention, it may be compressed portionwise as required and each portion detached for use after the compression. In order to facilitate the operation of the invention in this form, and avoid difficult cutting or tearing operations, the continuous material is advantageously made weak at regular intervals where the detachment is required. The weakness may be introduced by the incorporation of weak strips at the required intervals, by the use at intervals of a weak adhesive or by the use at intervals of the same adhesive as is used in the remainder of the product, but applied in such a manner, e.g. in specially narrow patches, in patterns of dots or in patches at only some of the normal positions, that the adhesive bonding can readily be broken.

The introduction of weakness as just described enables portions of expanded material to be produced readily with the first and last constituent strips of the permanently creasable material intact so that it has a row of complete cells, running across the direction of expansion, at each end. This is very desirable for packaging applications. For many structural applications, however, the presence of incomplete cells at the ends is unimportant and the material may simply be cut to size as required, no weakness being necessary. A convenient procedure is to cut it at a position where it has not been allowed to contract in the expansion direction.

In a preferred form of the method for structural applications, the material is passed between a pair of rollers as described above and is cut by a cutting device positioned after the rollers. Advantageously the cutting device is arranged to operate automatically after a required length of the compressed material has been delivered.

Thus one form of apparatus provided by the invention comprises a pair of compression rollers and, positioned thereafter, a cutting device arranged to operate automatically after a required length of the compressed material has been delivered.

The following description in which reference is made to the accompanying drawings is given in order to illustrate the invention.

Figure 2:
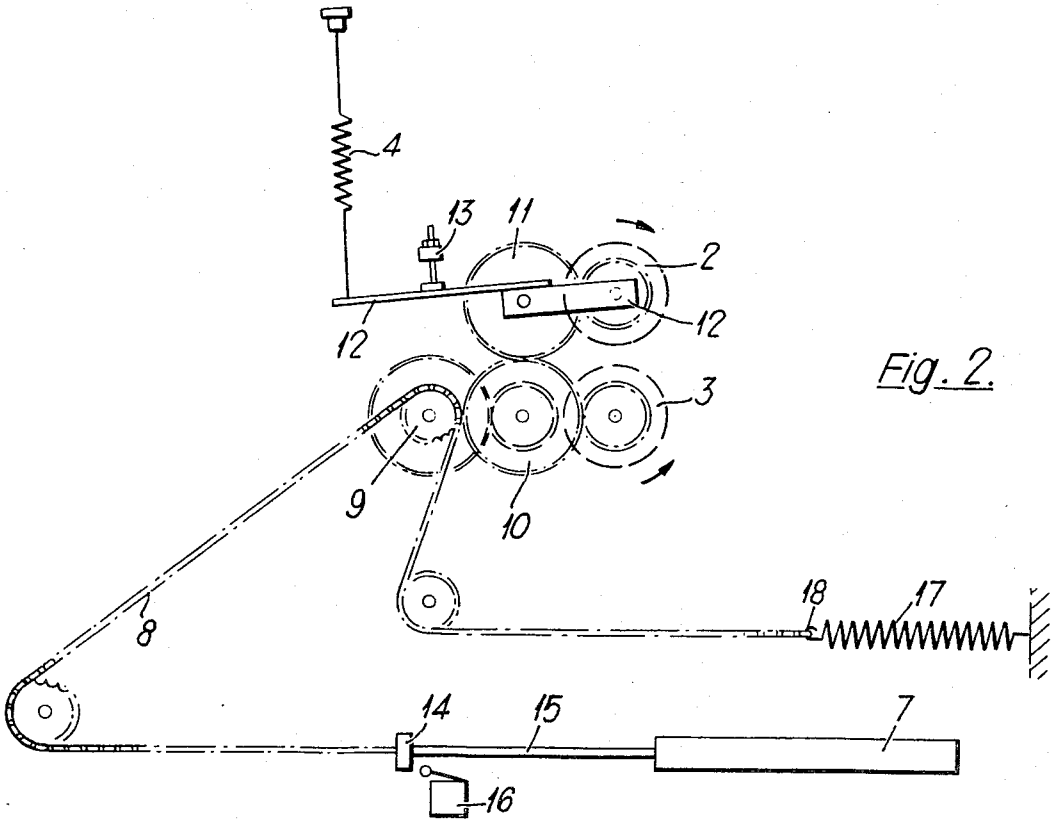

In the drawings:

FIG. 1 is a perspective showing the treatment of unexpanded honeycomb material using a method and apparatus according to the invention, and FIG. 2 shows parts of the apparatus in diagrammatic form.

In FIG. 1 is shown a continuous piece 1 of unexpanded honeycomb material formed from stout paper. A continuous piece of this kind may be made from slices produced in accordance with the principles described in British patent specification No. 591,772 by securing the slices together with patches of adhesive so arranged as to yield a continuous material.

The material is extended in the expansion direction by passage between a pair of driven compression rollers 2 and 3, resiliently urged together by a tension spring 4 (FIG. 2). As the material moves towards the rollers, it passes through an open cellular state and is then compressed perpendicularly to the expansion direction so that the cells are closed in the nip between the rollers. In the material passing through the nip, the individual strips of paper of which it is formed have a sharply closed zig-zag configuration. On emergence from the nip, the material contracts in the expansion direction (and expands across the expansion direction) thus opening out into a second cellular state shown at 5. Because of the creasing produced within the nip, the strips have lost all tendency to return to their original planar configuration and this cellular state is stable. In contrast, the same honeycomb material, expanded to the same area per unit weight by simply pulling it in the expansion direction, undergoes virtually no creasing in its constituent strips and it tends to close almost completely to the unexpanded state when the pulling force is removed.

It its second cellular state, the constituent cells are substantially rectangular and arranged in rows with the cells of one row displaced relative to the cells of the next row. The walls of the cells are inclined to the expansion direction.

Located beyond the nip at a position where no substantial contraction has taken place is a pneumatic cutting device 6 which is operated automatically to cut off pieces of the material as required. The compact form of the material at the cutting position enables a very simple cutting device to be employed.

The rollers are driven by the inward stroke of a pneumatic ram 7 which pulls upon a sprocket chain 8 to drive a free-wheel sprocket 9. Roller 3 is driven from the sprocket 9 via a gear train arranged as shown and including a pinion 10. This pinion meshes with a pinion 11 of the same size which drives the rollers 2. Pinions 10 and 11 are therefore rotated in opposite directions so that roller 2, which is driven from the pinion 11, is rotated in the opposite direction from roller 3.

Roller 2 is carried by one end of a lever assembly 12 pivotally mounted on the rotational axis of pinion 11. Spring 4 operates to rotate the lever assembly to urge roller 2 towards roller 3 until the lever assembly engages a stop 13.

The rotation of the rollers 2 and 3 in the directions of the arrows shown in FIGS. 1 and 2 continues until an abutment 14 on the piston rod 15 of the ram 7 trips a limit valve 16 of a pneumatic circuit, not shown. A spring 17, tensioned by the end 18 of the chain 8 is now free to pull the piston rod outwardly from the cylinder to return it to its starting position for a further operation. As the sprocket 9 freewheels whilst the piston rod returns, the feeding of compressed honeycomb material through the nip is halted. The cutting device may be actuated at any time before the rollers 2 and 3 are driven again by a further inward stroke of the ram to provide a severed piece of stable open cellular material whose length depends upon the position of the valve 16 which is adjustable along the path of the abutment 14.

A pneumatic control circuit, not shown, operates the ram 7 and the cutting device 6 to provide one severed piece of material in response to the pressing of a control button by the operator.

Severed pieces of stable open cellular material having any required length up to a maximum dependent upon the strokelength of the ram may be produced as required from the unexpanded material 1 in a very simple manner and without waste other than perhaps the very trivial waste of a remnant at the end 17 of the continuous material 1.

Heretofore, the most economic practice has been for users requiring honeycomb material in a range of sizes for structural purposes, e.g. for use as a core material in kitchen cabinets to procure a corresponding range of unexpanded slices. The application of the present invention can reduce significantly the stocking problems inherent in that practice in addition to providing the honeycomb material in a convenient stably expanded form.

In modification of the apparatus of FIGS. 1 and 2, a rotary or other sawing device may be used in place of the sheartype device shown, e.g. in order to cut material of large dimensions; the pneumatic mechanism may be replaced wholly or in part by hydraulic mechanism, and the rollers may be driven by an electric motor or motors via conventional reduction gearing.

It is to be understood that an expandable honeycomb material weakened at intervals for use with the present method is itself to be regarded as falling within the ambit of the present invention.

We claim:

1. A method of treating an unexpanded structural honeycomb material formed of a permanently creasable cellulosic material to convert it to a self-sustaining open cellular state which comprises extending the material in its expansion direction and thereby opening it out to a first open cellular state, further extending the material in said expansion direction while compressing it across said expansion direction and thereby closing the material from said first open cellular state to a compressed closed state, in which the cellulosic material is creased; releasing the material and allowing it to expand to a second open cellular state.

2. A method according to claim 1 in which the said extending of the material and its compression are accomplished by passing the material between a pair of pressure rollers

3. A method according to claim 2 in which at least one of the rollers is driven to exert a pull for the said extending of the material.

4. A method according to claim 2 in which the rollers are idler rollers and the said extending of the material and its compression are obtained by pulling it through the rollers.

5. A method according to claim 1 in which the unexpanded material is a continuous material which is compressed portionwise and each portion is detached after the compression.

6. A method according to claim 5 in which the continuous material is made weak at regular intervals where the detachment is required.

7. A method according to claim 5 in which the portions are detached by a cutting device arranged to operate automatically after a required length of the compressed material has been delivered.

* * * * *